US012286682B2

(12) United States Patent
Chen et al.

(10) Patent No.: US 12,286,682 B2
(45) **Date of Patent: *Apr. 29, 2025**

(54) HIGH STRENGTH STEEL PRODUCT AND A PROCESS TO PRODUCE A HIGH STRENGTH STEEL PRODUCT

(71) Applicant: TATA STEEL NEDERLAND TECHNOLOGY B.V., Velsen-Noord (NL)

(72) Inventors: Shangping Chen, Beverwijk (NL); Ashwath Ravi, Amsterdam (NL); Theo Arnold Kop, Haarlem (NL)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 684 days.

This patent is subject to a terminal disclaimer.

(21) Appl. No.: 17/604,221

(22) PCT Filed: Apr. 30, 2020

(86) PCT No.: PCT/EP2020/062100
§ 371 (c)(1),
(2) Date: Oct. 15, 2021

(87) PCT Pub. No.: WO2020/221889
PCT Pub. Date: Nov. 5, 2020

(65) Prior Publication Data

US 2022/0205058 A1 Jun. 30, 2022

(30) Foreign Application Priority Data

Apr. 30, 2019 (EP) ..... 19171942

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
CPC ..... C21D 2211/001; C21D 2211/002; C21D 2211/005; C21D 2211/008; C21D 8/0236;
(Continued)

(56) References Cited

U.S. PATENT DOCUMENTS 9,650,708 B2 5/2017 Becker et al.
2010/0108200 A1 5/2010 Futamura et al.
(Continued)

FOREIGN PATENT DOCUMENTS

CN 108603271 A 9/2018
CN 108699660 A 10/2018
(Continued)

OTHER PUBLICATIONS

International Search Report and Written Opinion mailed May 29, 2020 for PCT/EP2020/062100 to Tata Steel Ijmuiden B.V. filed Apr. 30, 2020.
(Continued)

*Primary Examiner* — Lois L Zheng
(74) *Attorney, Agent, or Firm* — Vorys, Sater, Seymour and Pease LLP; Anthony P. Venturino; Maryellen Feehery Hank

(57) ABSTRACT

A high strength steel product and a process for producing a high strength steel product, the high strength steel product being useful for producing frame components for vehicles and automobiles.

20 Claims, 1 Drawing Sheet

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C21D 8/0236* (2013.01); *C21D 8/0247* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/001* (2013.01); *C21D 2211/005* (2013.01); *C21D 2211/008* (2013.01)

(58) Field of Classification Search
CPC .. C21D 8/0247; C21D 8/0278; C21D 8/0205; C21D 6/002; C21D 6/005; C21D 6/008; C21D 9/52
See application file for complete search history.

(56) References Cited

U.S. PATENT DOCUMENTS

| | | | |
|---|---|---|---|
| 2011/0146852 | A1 | 6/2011 | Matsuda et al. |
| 2011/0162762 | A1 | 7/2011 | Matsuda et al. |
| 2011/0198002 | A1 | 8/2011 | Nakagaito et al. |
| 2014/0147697 | A1 | 5/2014 | Berkhout et al. |
| 2014/0242415 | A1 | 8/2014 | Azuma et al. |
| 2014/0305553 | A1 | 10/2014 | Masuda et al. |
| 2014/0322559 | A1 | 10/2014 | Becker et al. |
| 2015/0101712 | A1 | 4/2015 | Futamura et al. |
| 2015/0167133 | A1 | 6/2015 | Paul et al. |
| 2015/0184274 | A1 | 7/2015 | Kakiuchi et al. |
| 2016/0208359 | A1 | 7/2016 | Kasuya et al. |
| 2016/0237520 | A1 | 8/2016 | Murata et al. |
| 2017/0137910 | A1* | 5/2017 | Girina ..... C22C 38/18 |
| 2017/0191150 | A1 | 7/2017 | Hanlon et al. |
| 2018/0010207 | A1 | 1/2018 | Futamura et al. |
| 2019/0040482 | A1 | 2/2019 | Kimata et al. |
| 2019/0040483 | A1 | 2/2019 | Kimata et al. |
| 2019/0338388 | A1 | 11/2019 | Pipard et al. |
| 2020/0040420 | A1 | 2/2020 | Minami et al. |
| 2020/0190612 | A1 | 6/2020 | Kwak et al. |
| 2020/0283869 | A1 | 9/2020 | Toda et al. |
| 2021/0262069 | A1 | 8/2021 | Irnich et al. |
| 2022/0316021 | A1 | 10/2022 | Chen et al. |
| 2022/0316024 | A1 | 10/2022 | Chen et al. |
| 2022/0316025 | A1 | 10/2022 | Chen et al. |
| 2022/0316026 | A1 | 10/2022 | Chen et al. |

FOREIGN PATENT DOCUMENTS

| | | | |
|---|---|---|---|
| CN | 109295389 | A | 2/2019 |
| EP | 1870482 | A1 | 12/2007 |
| EP | 2267176 | A1 | 12/2010 |
| EP | 2325346 | A1 | 5/2011 |
| EP | 2436794 | A1 | 4/2012 |
| EP | 2546375 | A1 | 1/2013 |
| EP | 2546382 | A1 | 1/2013 |
| EP | 2765212 | A1 | 8/2014 |
| EP | 2831296 | B1 | 2/2015 |
| EP | 2831299 | A1 | 2/2015 |
| EP | 2881481 | A1 | 6/2015 |
| EP | 3144406 | A1 | 3/2017 |
| EP | 3581670 | A1 | 12/2019 |
| EP | 3712284 | A1 | 9/2020 |
| EP | 3754035 | A1 | 12/2020 |
| EP | 3963115 | | 3/2022 |
| JP | 2010090475 | A | 4/2010 |
| JP | 2013072101 | A | 4/2013 |
| JP | 2013124399 | A | 6/2013 |
| JP | 2013124400 | A | 6/2013 |
| JP | 2014047395 | A | 3/2014 |
| JP | 2015516511 | A | 6/2015 |
| JP | 2015200006 | A | 11/2015 |
| JP | 2016130358 | A | 7/2016 |
| JP | 2017528592 | A | 9/2017 |
| KR | 1020170078541 | A | 7/2017 |
| KR | 101877787 | B1 | 7/2018 |
| WO | 2012156428 | A1 | 11/2012 |
| WO | 2013144373 | A1 | 10/2013 |
| WO | 2013144377 | A1 | 10/2013 |
| WO | 2013146087 | A1 | 10/2013 |
| WO | 2016001707 | A1 | 1/2016 |
| WO | 2016001898 | A2 | 1/2016 |
| WO | 2017108959 | A1 | 6/2017 |
| WO | 2017115107 | A1 | 7/2017 |
| WO | 2017125809 | A1 | 7/2017 |
| WO | 2017138503 | A1 | 8/2017 |
| WO | 2018099819 | A1 | 6/2018 |
| WO | 2018110867 | A1 | 6/2018 |
| WO | 2018115933 | A1 | 6/2018 |
| WO | 2018115936 | A1 | 6/2018 |
| WO | 2018116155 | A1 | 6/2018 |
| WO | 2018147400 | A1 | 8/2018 |
| WO | 2019063081 | A1 | 4/2019 |
| WO | 2019097600 | A1 | 5/2019 |
| WO | 2019238741 | A1 | 12/2019 |
| WO | 2020221889 | A1 | 11/2020 |
| WO | 2020254186 | A1 | 12/2020 |
| WO | 2020254187 | A1 | 12/2020 |
| WO | 2020254188 | A1 | 12/2020 |
| WO | 2020254190 | A1 | 12/2020 |

OTHER PUBLICATIONS

Guhui Gao et al: "A carbide-free bainite/martensite/austenite triplex steel with enhanced mechanical properties treated by a novel quenching-partitioning-tempering process", Materials Science and Engineering A, vol. 559, Jan. 1, 2013, pp. 165-169, XP055176061, ISSN: 0921-5093.

A.-F. Gourguesh. M. Flowert. C. Lindley, Materials Science and Technology, vol. 16, Jan. 2000 (Jan. 1, 2000), pp. 26-40.

J. Goldstein et al., Scanning Electron Microscopy and X-Ray Microanalysis, Springer, New York, pp. 147-164, published on Nov. 18, 2017.

Notification of Reason for Rejection mailed Jul. 2, 2024 in Japanese Patent Application No. 2021-575078 (Translation of Official Action).

* cited by examiner

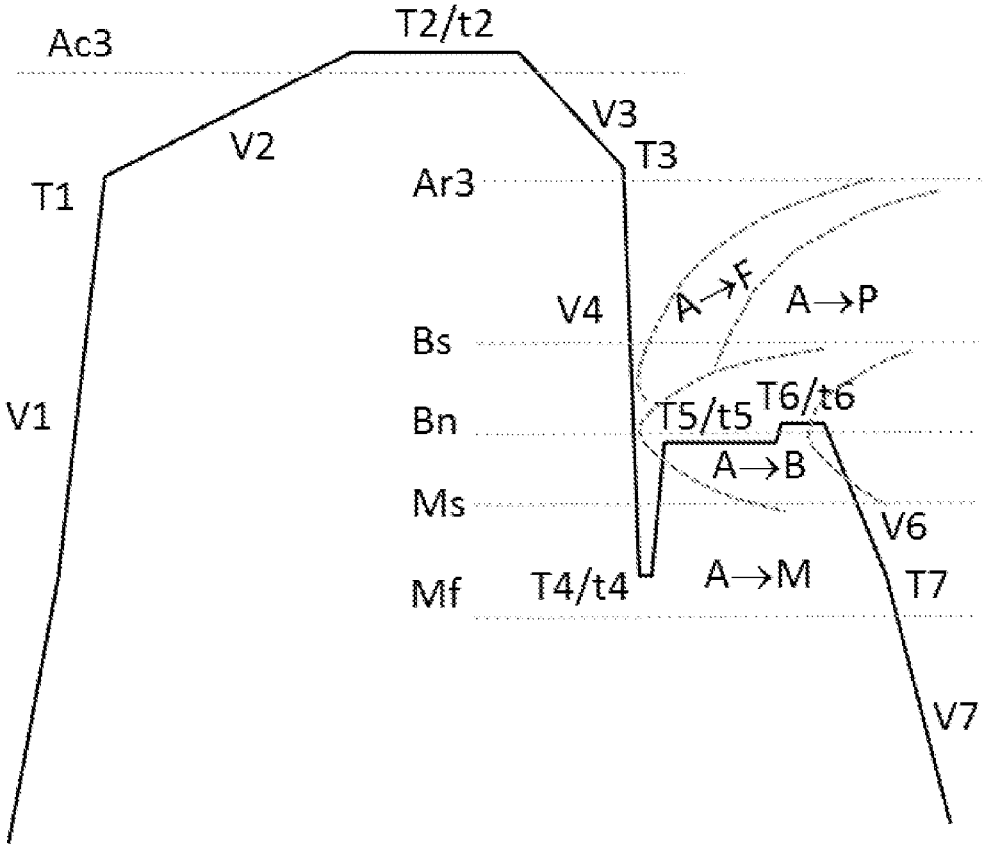
Ac3
T2/t2
V3
V2
T3
T1
Ar3
A→F
A→P
V4
Bs
V1
T6/t6
T5/t5
Bn
A→B
Ms
V6
T4/t4
A→M
T7
Mf
V7

HIGH STRENGTH STEEL PRODUCT AND A PROCESS TO PRODUCE A HIGH STRENGTH STEEL PRODUCT

CROSS-REFERENCE TO RELATED APPLICATIONS

This is a § 371 National Stage Application of International Application No. PCT/EP2020/062100 filed on Apr. 30, 2020, claiming the priority of European Patent Application No. 19171942.6 filed on Apr. 30, 2019.

This invention relates to a high strength steel product and a process for producing a high strength steel product, the high strength steel product being useful for producing frame components for vehicles and automobiles.

In recent years, (advanced) high strength steels, AHSS, are increasingly used in car components to reduce weight and fuel consumption. A series of (advanced) high strength steels, such as HSLA, Dual phase (DP), Ferritic-bainitic (FB) including stretch-flangeable (SF), Complex phase (CP), Transformation-induced plasticity (TRIP), Hot-formed, Twinning-induced plasticity (TWIP) has been developed to meet the growing requirements.

However, AHSS sheet steels cannot be applied easily to a wide variety of car components because their formability is relatively poor. There are two types of formability, drawability and stretch flangeability. The drawability is governed by global ductility, characterized by elongation in tensile tests, the stretch flangeability is governed by local ductility, characterized by hole expansion ratio in hole expansion tests or by bending angle in bending tests, respectively. Global ductility and local ductility are generally incompatible. The total elongation depends mainly on the strain localisation in the matrix phase of the microstructure while the local ductility depends on the micro-scale uniformity. As steels became increasingly stronger, they simultaneously became increasingly difficult to form into automotive parts. The DP steels provide a higher global ductility due to the soft ferrite matrix but lower local ductility due to the large strength difference between ferrite and martensite. In contrast, CP steels yield a lower global ductility as a result of the reduced amount of the soft ferrite and a higher local ductility as a result of the reduced hardness difference among the phases and a more uniform distribution of microstructure. The application of AHSS steels (DP, CP and TRIP) to car components is still limited by their formability. Therefore, improving formability and manufacturability is an important issue for AHSS applications. To achieve a high yield strength/tensile strength ratio and an even higher tensile strength, i.e. above 800 MPa, steels having complex microstructures (ferrite, bainite martensite and/or retained austenite) have been developed.

Transformation-induced plasticity (TRIP) steel is one of these high-strength steels that utilize phase transformation to control the mechanical properties. Strain-induced martensitic transformation of metastable austenite plays a major role in improving the mechanical balance (tensile strength× elongation), allowing TRIP steel to be actively applied in the automotive industry. Currently, the tensile strength of commercially produced TRIP steel reaches approximately 1000 MPa. However, when the tensile strength exceeds 800 MPa, the elongation tends to decrease to less than 15% and the mechanical balance is significantly deteriorated. A microstructural control ensuring higher stability as well as sufficient retained austenite is essential to obtain a higher tensile strength with desirable elongation.

Low-carbon, manganese TRIP steel (Mn TRIP steel) based on an alloy system of Fe-0.1C-5Mn was first introduced by Miller [R. L. Miller: Metall. Trans., 1972, vol. 3, pp. 905-12]. A retained austenite fraction of 20~40% with optimized stability made it possible to exhibit an excellent mechanical balance after intercritical annealing. However, a prolonged heat treatment using a batch-type annealing process is required to obtain the desired properties, which renders the method unsuitable for industrial scale.

Alternatively, in EP2546382 a high strength steel is described with good elongation. However, also in this case the provided microstructure has a slow formation rate, rendering production of such steel strips unfeasible for industrial application.

It is an object of the present invention to provide a steel which combines high strength with good formability.

It is also an object of the present invention to provide a process for producing a steel grade which combines high strength with good formability.

According to a first aspect one or more of the objects of the invention is reached by a high strength steel product comprising:

0.20-0.55 wt. % C;
1.00-3.50 wt. % Mn;
0.05-2.50 wt. % Cr;
0.50-3.00 wt. % Si;
0.01-1.00 wt. % Al;
1.00-4.00 wt. % of Σ (Si+Al);
1.50-6.00 wt. % of Σ (Cr+Mn);
at most 0.050 wt. % P;
at most 0.020 wt. % S;
at most 0.010 wt. % N;
and optionally one or more of:
0.05-0.50 wt. % Cu;
0.05-1.00 wt. % Ni;
0.05-0.50 wt. % Mo;
0.01-0.10 wt. % Nb;
0.01-0.10 wt. % Ti;
0.01-0.10 wt. % V;
0.0003-0.0050 wt. % B;
0.01-0.15 wt. % of Σ (Nb+Ti+V);
0.0003-0.0100 wt. % of Σ (Ca+REM);

remainder iron and inevitable impurities, and wherein the microstructure comprises at least 40% partitioned martensite and 60-90% of Σ (partitioned martensite+bainitic ferrite) and 5-35% of retained austenite; and wherein the retained austenite comprises an average C content of 0.90% or more. The favourable balanced properties of a steel product according to the invention is realized due to a microstructure comprising a matrix of partitioned martensite and bainitic ferrite in combination with retained austenite with 0.90% of average C content or more. The matrix of bainitic ferrite and partitioned martensite provides high strength due to a high dislocation density and supersaturated carbon in the matrix. This matrix also provides high elongation and stretch flangeability since it is substantially carbide-free. The fine retained austenite, which is present on the boundary of lath-shaped bainitic ferrite and/or partitioned martensite, provides extra elongation due to the TRIP effect.

The steel product according to the invention is not particularly limited to a specific type and can be in the form of a steel strip, sheet, blank or hot-press formed steel product.

In conventional steels as-quenched martensite is obtained as a highly supersaturated solid solution of carbon in α-iron. Although it is very strong, the structure is normally brittle. The mechanical properties are typically further adjusted by heat treatment called tempering at an elevated temperature.

In conventional steels, during tempering, carbon is rejected from the supersaturated solid solution and forms finely divided carbide phases within the martensite. Conventional tempered martensite therefore contains a fine dispersion of carbides in an α-iron matrix.

In the steel according to the invention, martensite initially forms supersaturated with carbon as described above. The carbon is also rejected from the supersaturated solid solution, but the formation of carbides is suppressed during tempering due to the presence of 1.00% or more of the sum of Si and Al in the composition. As a result, the carbon partitions from martensite to austenite which leads to carbon enriched retained austenite with higher stability and carbide free tempered martensite may be formed. The resultant martensite is referred to as partitioned martensite, which has a plate (lath)-like microstructure and is carbide free. This partitioned martensite increases the overall elongation and formability properties of the steel compared to conventional tempered martensite.

A similar principal renders the bainitic structure carbide free. Bainite is a plate-like microstructure that forms in steels at temperatures between those where pearlite and martensite form. In conventional steels, bainite contains ferritic plates intertwined with finely dispersed carbides, which is supersaturated with carbon and has a high density of dislocations. However, in the steels according to the invention containing sufficient amount of Si and Al, the carbide formation is restricted or retarded during austempering and the austenite remains carbon enriched. Therefore, in a limited time frame the bainite can be obtained carbide-free. This carbide-free bainite is called bainitic ferrite.

The steel according to the invention will possess high strength in combination with good elongation and good formability. A high strength steel preferably has a tensile strength of at least 1000 MPa.

In a preferred embodiment the steel according to the invention has a tensile strength of at least 1300 MPa and/or a total elongation of at least 10%, preferably at least 13%.

In a further preferred embodiment, the steel according to the invention will have a hole expansion capacity (HEC) of at least 10% and/or a bending angle of at least 70°. More preferably, the steel according to the invention will have a HEC of at least 15%, more preferably 20% and/or a bending angle of at least 80°, more preferably 90°.

Carbon (C) is a necessary element in the steel according to the invention for strength and hardenability and enables the stabilisation of retained austenite. The strength of the steel, the amount of the retained austenite and the average C content in the retained austenite increase as the carbon content is increased. The retained austenite provides the TRIP effect. It is required that the carbon content of the composition is controlled at an appropriate level to control the desired microstructure and maintain the delicate balance of microstructure and properties. For the steels according to the invention the carbon content is from 0.20 to 0.55 wt. % (all compositional percentages are in weight percent (wt. %) unless otherwise indicated). A suitable minimum amount is 0.20%, preferably at least 0.25%, more preferably at least 0.30%. A suitable maximum amount is 0.55%, preferably at most 0.50%, more preferably at most 0.45%, most preferably at most 0.43%. Carbon content in steel lower than 0.20% makes it difficult to obtain the required high strength and good formability of a steel sheet as the retained austenite is not stable enough because the average C content in the retained austenite phase is not high enough. A carbon content exceeding 0.55% results in significant hardening of any welded portions and heat-affected zones, thereby deteriorating weldability.

Silicon (Si) and Aluminium (Al) are compulsory elements in the steel according to the invention and are added to suppress the formation of carbides and increase the concentration of C in austenite, thereby promoting the formation of residual austenite and contributing to a microstructure providing a good balance between strength and ductility of the steel product. The sum of Si and Al (Si+Al) should be at least 1.00% to reach the effects, preferably the sum is at least 1.30%, more preferably the sum is at least 1.50%. As Al is less effective as Si, Al can be added to partially replace Si for this function. The content of Al should be less than ¼ of Si, preferably, less than ⅕ of Si. The sum total of Si and Al should be at most 4.00%, preferably at most 3.50% and more preferably at most 3.00%.

The main function of Si is to prevent carbon from precipitating in the form of iron carbides, most commonly cementite and to suppress decomposition of residual austenite. Si also contributes to increasing the strength of a steel sheet through solute strengthening. Si has a function of improving the ductility, work hardenability and stretch flangeability through the retardation of austenite grain growth during annealing. A minimum of at least 0.50%, preferably at least 0.80% Si is needed to sufficiently suppress the formation of carbides. The upper limit for Si is set at 3.00%. A higher Si content will result in deterioration of formability and toughness due to increase in content of solute Si in polygonal ferrite. Si may have negative effects on the surface quality of the steel sheet due to generation of red scales and may reduce coating adhesion when the steel sheet is subjected to hot dip galvanizing. Accordingly, the Si content in steel according to the invention is to be 3.00% or less, preferably 2.50% or less. Preferably, Si is in the range of 0.80-2.00% in view of wettability in combination with suppression of carbide formation and promotion of austenite stabilisation.

The primary function of Al is to deoxidise the liquid steel before casting for which 0.01% or more is needed, preferably 0.05% or more. Furthermore, Al has a similar function as Si to prevent the formation of carbides and to stabilize the retained austenite, although Al is not as effective as Si and has no significant effect on strengthening. Too high levels of Al increase the ferrite to austenite transformation point temperature to levels that are incompatible with conventional installations and will therefore not provide a microstructure according to the invention. In addition, the risk of cracking during casting increases as the Al content is increased. Therefore, the upper limit is set to 1.00%, preferably 0.70% or less. In the context of the application the aluminium content is expressed as Al_tot.

Manganese (Mn) is required to stabilize the retained austenite and to obtain hardenability of the steel. Mn is also added to balance the elevated phase transformation point as a result of high amounts of Si and Al. If the Mn content is less than 1.00%, the above-described microstructure is difficult to obtain because of the low hardenability of the steel. Therefore, Mn needs to be added at 1.00% or more, preferably 1.50% or more. The upper limit of Mn is 3.50% or less, preferably 3.00% or less as Mn in an excessive amount leads to slow bainitic transformation kinetics, which results in too much fresh martensite during final cooling. In addition, a large amount of Mn promotes macro-segregation, which results in unfavourable band formation in steels and in deteriorated stretch flangeability.

Chromium (Cr) is a compulsory element in the steel according to the invention, which increases the strength of the steel by increasing the hardenability and stabilizes the retained austenite. Cr may also change the state of carbide formation which results in good formability in the hard, high strength partitioned martensite. This effect is provided at a Cr content of 0.05% or more, preferably 0.20% or more. Meanwhile, when Cr is added excessively, the effect is saturated and the bainitic transformation becomes too slow to obtain the required microstructure in a production line. Therefore, the upper limit of Cr is set to 2.50% or less, preferably 2.00% or less.

To ensure the hardenability and high strength, the sum of Cr and Mn should be 1.50% or more, preferably 2.00% or more. The upper limit of the sum of Cr and Mn is set to be 6.00% or less, preferably 4.00% or less, to prevent that the bainitic transformation kinetics will become too slow.

The following elements may be optionally added as alloying elements to the composition of the steel according to the invention.

Copper (Cu) may optionally be added to the steel according to the invention to facilitate the removal of high-Si scales formed in the hot rolling stage and improve the corrosion resistance when the cold rolled steel sheet is used as such without surface treatment or improve the wettability by molten zinc. Cu can promote bainitic structures and may cause solid solution hardening. Cu also reduces the amount of hydrogen penetrating the steel and thus improves the delayed fracture characteristic. When Cu is added as alloying element, the minimal content should be 0.05% or more, preferably 0.10% or more. However, Cu causes hot shortness if an excess amount is added. Therefore, when Cu is added, the Cu content should be 0.50% or less, preferably 0.30% or less.

Nickel (Ni) and/or Mo (Molybdenum) may optionally be added to the steel according to the invention. When added, these elements improve the hardenability of the steel and facilitate the formation of bainite ferrite, and at the same time may stabilize retained austenite. Therefore, Ni and/or Mo, when added, are very effective for the microstructural control and should be present at 0.05% or more to sufficiently obtain this effect. However, when added excessively, the effect is saturated, and the cost of the steel is significantly increased. Therefore, Mo is set to be at most 0.50%, preferably at most 0.30%, and the amount of Ni is set to be at most 1.00%, preferably at most 0.5%. Ni may also be used to reduce the tendency of hot shortness when a high amount of Cu is added. For this purpose, the amount of Ni is preferably at least ⅓ of the Cu content to effectively prevent hot shortness.

Niobium (Nb), Vanadium (V) and/or Titanium (Ti) may also be optionally added in the steel. These elements can be used to refine the microstructure in the hot rolled intermediate product and the finished products. They possess a precipitation strengthening effect and may change the size or morphology of the bainitic ferrite and the partitioned martensite. They have also a positive contribution to optimization of application depending properties like stretched edge ductility and bendability. If present, the lower limit of Nb, V and/or Ti to cause this effect should be at least 0.01%. If any of these elements are present, they should be limited at 0.10% or less, to prevent deterioration of the formability of the steel. Accordingly, in a case where the steel composition includes Ti, V and Nb, contents thereof are to be Ti: 0.01% to 0.10%, V: 0.01% to 0.10% and Nb: 0.01% to 0.10%. The total amount of Ti+Nb+V should be 0.15% or less, preferably 0.10% or less.

Boron (B) is an optional element in the invented steel. It is a useful element in terms of suppressing formation and growth of polygonal ferrite from austenite grain boundaries. If present, the B content should be at least 0.0003%, preferably 0.0005%, whereas the upper limit is set to 0.0050% or less, preferably 0.0040% or less. A boron content in steel exceeding 0.0050% deteriorates formability of a resulting steel sheet. For the boron to be able to perform this role, it is essential that no free nitrogen is present so that the formation of BN is avoided. This is where the nitrogen scavenging effect of certain elements such as titanium or aluminium plays a role.

Phosphorus (P) is an impurity in the steel. P segregates the grain boundaries and therefore decreases the workability and deteriorate impact resistance. Therefore, the amount of P should be suppressed to 0.050% or less, preferably 0.020% or less, more preferably 0.010% or less. For the properties of the steel, the content of P is preferably minimized as far as possible. For production cost, the lower limit of phosphorus content in steel is preferably around 0.005% because decreasing P content below 0.005% significantly increases production costs.

Sulphur (S) is a harmful impurity in the steel which forms sulphide-based inclusions such as MnS, which may serve as a crack initiator, thereby deteriorating processability, impact resistance and stretch flange formability of the steel. Therefore, it is desirable to reduce the amount of S as much as possible. Accordingly, S is 0.020% or less. Preferably S is 0.010% or less, more preferably 0.008% or less. For production cost, the lower limit of sulphur content in steel is preferably around 0.0005% because decreasing S content below 0.0005% significantly increases production costs.

Nitrogen (N) is inevitably present in the steel making process and allowable in the steels according to the invention in amounts up to 0.010%. N can be present in three nitrogen-related phenomena i.e. formation of blowholes, precipitation of one or more nitride compounds with microalloying elements such as Ti, Al and B and the interstitial solid element in solution. N in solid solution can markedly increases hardness and yield strength and decreases the tensile elongation. However, N deteriorates the toughness and formability of steel when an excess amount of 0.010% is added due to the formation of coarse nitride compounds or blowholes. Accordingly, nitrogen content in steel is to be 0.010% or less, preferably 0.006% or less. The practical lower limit of nitrogen content in steel is around 0.001% in view of production costs because decreasing nitrogen content in steel below 0.001% significantly increases production costs. A suitable and practical minimum N content is between 0.001% to 0.005%.

Optionally, at least one element selected from Ca and REM (rare earth element) is used, wherein the sum of Ca+REM is 0.0100% or less. These Ca and REM are elements effective for controlling a form of sulphide in the steel and for improving processability. Examples of the rare earth element include Scandium, Yttrium. It is recommended that for these elements to be useful they have to be present in amounts of 0.0003% or higher. However, when added excessively, the effect saturates and the economic efficiency is reduced. Therefore, it is better to suppress an amount thereof to 0.0100% or less, preferably 0.0050% or less, more preferably to 0.0030% or less.

The other elements present in the steel are those usually found as manufacturing impurities, in proportions which have no significant effect on the required properties of steel. These residual elements (aka inevitable impurities, such as As, Pb, Sn, Mo, etc.) are defined as elements which are not added on purpose to steel and which cannot be removed by simple metallurgical processes. Some of the elements can be present as residual element, like nickel, but nickel can also be added to the steel during steelmaking, in which case it would no longer be a residual element or inevitable impurity, but an alloying element. In many cases it cannot be determined in the finished steel product whether (e.g.) nickel was added as an alloying element, or whether it was present as a residual element. Residual elements enter steel from impurities in ore, coke, flux and scrap; from these, scrap is the main source of residuals. Consequently, the level of residual elements in the Electric Arc Furnace process route (100% scrap based) is significantly higher than in the Basic Oxygen Steelmaking process route. The most commonly found residuals are Cu, Ni, Mo, and Sn. The acceptance limits of these residuals depend mainly on product requirements. Preferably the steel according to the invention is produced in a BOS-process route, in which case the allowable levels of residual elements for Cu, Ni, Mo and Sn are 0.040, 0.040, 0.020 and 0.020 wt. % respectively.

In a further preferred embodiment in the steel according to the invention the Cu and/or Ni and/or Mo and/or Nb and/or Ti and/or V and/or B belongs to the inevitable impurities The steel according to the invention has a complex phase microstructure, comprising in volume percent (vol. %) 60-90% of (partitioned martensite+bainitic ferrite) and 5-35% of retained austenite; and wherein the retained austenite comprises an average C content of 0.90% or more.

The matrix of a mixture of partitioned martensite (PM) and bainitic ferrite (BF) ensures a good balance in the strength and ductility of the steel. The BF in these steels is generally present in the form of plates with an ultrafine grain size (typically about 5 μm long and about 200 nm thick). The PM has a similar substructure to BF but with a finer size of substructure. The size of the ferrite lath and retained austenite is smaller in PM than in BF, thereby contributing to strength and the stability of the retained austenite. The PM which is formed before BF can also accelerate the bainite transformation kinetics of the untransformed austenite during overaging. To ensure the required mechanical properties, as well as to reduce the amount of the fresh martensite formed during final cooling, the sum of PM and BF should be at least 60%. If the sum of PM and BF is too low, too much fresh martensite may be produced which makes it impossible to simultaneously improve strength and formability. On the other hand, when the amount of PM and BF is too large, the amount of the retained austenite is not enough and the elongation of the steel is remarkably reduced. Therefore, the total percentage of PM and BF should be from 60% to 90%, preferably from 65% to 85%, more preferably from 70% to 80%.

Retained austenite (RA) enhances ductility partly through the TRIP effect, which manifests itself in an increase in uniform elongation. The volume fraction of retained austenite is controlled to be 5% or higher, preferably 10% or higher, more preferably 15% or higher. Below 5% the desired level of elongation will not be achieved. However, when the volume fraction is greater than 35%, the average carbon content in the retained austenite becomes too low. The retained austenite is not stable enough to contribute the TRIP effect and also the stretch flangeability will deteriorate. Therefore, the upper limit of retained austenite is 35% or less, preferably 30% or less, more preferably 25% or less.

The carbon content in retained austenite is important in terms of obtaining excellent formability by utilizing a TRIP effect in the invented high strength steel. The inventors discovered that good formability can be obtained when the average carbon content in retained austenite is at least 0.90%. Without wishing to be bound to theory, it is believed that if the carbon content in retained austenite is lower than 0.90%, the retained austenite is not sufficiently stable. The austenite with low stability may cause martensitic transformation to occur in a low strain region in processing of a steel, which results in insufficient TRIP effect in a high strain region, and which also reduces the overall formability of the steel sheet. Accordingly, the average carbon content in retained austenite is preferably at least 0.90% and more preferably at least 0.95%. The carbon content in retained austenite exceeding 2.00% might render retained austenite too stable, whereby martensitic transformation does not occur during processing of a steel. No TRIP effect is possible and thus ductility of the steel sheet deteriorates. Accordingly, the average carbon concentration in retained austenite is preferably 2.00% or less, more preferably 1.60% or less.

In a further embodiment of the invention, the microstructure comprises at least 45% of partitioned martensite. As described above PM and BF are both carbide free, but ferritic plates in PM is finer than in BF. The size of retained austenite is also smaller in PM and the distribution of retained austenite in PM is more uniform, which render a more stable retained austenite and is beneficial to formability. Moreover, the preformation of partitioned martensite can intrigue the bainite nucleation and accelerate the transformation of bainitic ferrite thereby reducing the overall processing time and reducing the amount of fresh martensite, which is beneficial to both elongation and formability. Therefore, the amount of partitioned martensite should preferably be at least 45%, more preferably at least 50%, most preferably at least 60%. If the amount of PM is less than 40%, bainitic transformation may not be complete during a limited overageing time and fresh martensite may form in an excess amount during final cooling. On the other hand, if the amount of PM is higher than 90%, the amount of retained austenite is too low for producing sufficient TRIP effect. Thus, the amount of PM should be at most 90%, preferably at most 85%, more preferably at most 80%.

In a further embodiment of the invention, the microstructure comprises at most 50% of bainitic ferrite, preferably at most 35%, more preferably at most 20%, in order to allow for a sufficient amount of partitioned martensite. Preferably, the matrix comprises a larger amount of partitioned martensite than bainitic ferrite.

In a further embodiment of the invention, the microstructure comprises 0-15% of proeutectoid ferrite (PF). Proeutectoid ferrite may form during annealing if the annealing temperature is too low and/or the annealing time is too short, or during cooling process if the cooling rate is too low. The presence of the proeutectoid ferrite increases the total elongation but decreases strength and formability. When the amount of proeutectoid ferrite is higher than 15%, it is difficult to achieve both a high tensile strength of 1300 MPa or more and a hole expansion capacity of 20% or more. Therefore, the amount of proeutectoid ferrite should preferably be 15% or less, more preferably 5% or less, most preferably 1% or less.

In a further embodiment of the invention, the microstructure comprises 0-5% of fresh martensite (FM). Some amount of fresh martensite may be produced during final cooling if the bainitic transformation is incomplete during overaging. The presence of the fresh martensite further increases the strength of the steel. However, when the volume fraction of martensite is greater than 5%, the hole expansion capacity is remarkably reduced. Therefore, the volume fraction of martensite is preferably limited to a maximum amount of 5%, more preferably less than 2%, most preferably 0%.

In a further embodiment of the invention, the microstructure comprises 0-1.5% of carbides. Carbides may be present in addition to proeutectoid ferrite, partitioned martensite, bainitic ferrite and fresh martensite and retained austenite when the overageing temperature is too high and/or the overageing time is too long. The formation of carbides reduces the amount of the retained austenite and the average C content in the retained austenite, which deteriorate both the strength and ductility. If the amount of the carbides is higher than 1.5%, the minimum amount of retained austenite and the stability of the retained austenite cannot be ensured. Therefore, the amount of the carbide should preferably be limited to be less than 1.5%, more preferably less than 0.5%, most preferably 0%.

According to a second aspect one or more of the objects of the invention may be reached with a process for producing a high strength product, comprising the steps of:

A. providing a cold rolled steel having the following composition;
   0.20-0.55 wt. % C;
   1.00-3.50 wt. % Mn;
   0.05-2.50 wt. % Cr;
   0.50-3.00 wt. % Si;
   0.01-1.00 wt. % Al;
   1.00-4.00 wt. % of Σ (Si+Al);
   1.50-6.00 wt. % of Σ (Cr+Mn);
   at most 0.050 wt. % P;
   at most 0.020 wt. % S;
   at most 0.010 wt. % N;
   and optionally one or more of:
   0.05-0.50 wt. % Cu;
   0.05-1.00 wt. % Ni;
   0.05-0.50 wt. % Mo;
   0.01-0.10 wt. % Nb;
   0.01-0.10 wt. % Ti;
   0.01-0.10 wt. % V;
   0.0003-0.0050 wt. % B;
   0.01-0.15 wt. % of Σ (Nb+Ti+V);
   0.0003-0.0100 wt. % of Σ (Ca+REM);
   remainder iron and inevitable impurities,
B. heat treating the cold rolled steel at a temperature T2 above Ac3—20° C. for a duration t2 of between 1 and 300 s;
C. cooling the annealed steel, at a cooling rate V4 of at least 25° C./s to a quenching temperature T4 between Ms and Mf;
D. heat treating the annealed steel at a partitioning temperature T5 above between Bs and Ms for a duration t5 of between 15 and 150 s; and
E. cooling to ambient temperature, to obtain a steel product wherein the microstructure comprises at least 40% partitioned martensite and 60-90% of Σ (partitioned martensite+bainitic ferrite) and 5-35% of retained austenite; and wherein the retained austenite comprises an average C content of 0.90% or more. The steel product obtained by the process may be a steel strip, sheet, blank or a hot-pressed formed product.

The definitions of the phase transition temperatures are well known to a person skilled in the art and are dependent on the alloy composition. Ac3 is defined as the temperature at which, during heating, transformation of the ferrite into austenite ends. Ar3 is defined as the temperature at which austenite begins to transform to ferrite during cooling. Ar1 is defined as the temperature at which austenite transforms to pearlite during cooling. Bs is defined as the temperature at which, during cooling, transformation of the austenite into bainite starts. Bn is defined as the nose temperature of the bainitic transformation in the time-temperature transformation (TTT) curve of a steel, at which transformation of the austenite into bainite has the fastest kinetics. Ms is defined as the temperature at which, during cooling, transformation of the austenite into martensite starts. Mf is the temperature at which, during cooling, transformation of the austenite into martensite ends. A practical problem with Mf is that the martensite fraction during cooling approaches the maximum achievable amount only asymptotically, meaning that it takes very long for the last martensite to form. For practical reasons and in the context of this invention, Mf is therefore defined as the temperature at which 90% of martensite has formed. All these temperatures can be accurately determined by dilatometer experiments. As the Ac3 is a function of heating rate, the Ac3 in this invention is measured at a heating rate of 2° C./s.

Alternatively, Ac3, Bs and Ms points can be calculated beforehand, using the following empirical formula, wherein the alloying elements in the steel are given in wt. %:

$$Ac3\ (^\circ\ C.)=942-203C^{0.5}+44.7Si-30Mn+130Al-11Cr-15.2Ni-20Cu+31.5Mo$$

$$Bs\ (^\circ\ C.)=839-86Mn-23Si+67Cr+35\sqrt{Al}-270(1-\exp(-1.33C))$$

$$Ms\ (^\circ\ C.)=539-423C-30.4Mn-7.5Si+30Al$$

Ambient temperature is defined as the temperature of the surrounding air, and is also referred to as room temperature. The Oxford English Dictionary defines a typical value for room temperature to be 20° C.

By applying the quenching and partitioning (Q&P) process according to the invention on a cold-rolled steel with the above described composition the amount of the partitioned martensite, bainitic ferrite and retained austenite, as well as the carbon content in the retained austenite is optimized providing the product with the high strength and good ductility of the carbide-free bainitic ferrite and partitioned martensite and the extra elongation due to the TRIP effect from the retained austenite. In this invention, the partitioned martensite is obtained during quenching and partitioning when the quenching stop temperature T4 is between Mf and Ms and partition is conducted in the overageing temperature range between Ms and Bs. The bainitic ferrite is obtained by transformation of the untransformed austenite during partitioning. The amount of partitioned martensite depends on the quenching temperature whereas the amount of bainitic ferrite is controlled by the partition temperature and time.

The provided cold rolled steel according to the invention can be obtained as well known to a person skilled in the art and can be in the form of a strip, sheet or blank. Typically, a steel slab is prepared to have the preferred component composition described above and the steel slab is subjected to hot rolling and then cold rolling to obtain a cold rolled steel strip. These processes are not particularly restricted and may be carried out according to conventional methods. Preferable manufacturing conditions of a cold rolled steel strip include: (re)heating a steel slab to a temperature in the range of 1100° C. to 1300° C.; optionally hot-rolling the slab or cast strip to a hot-rolled strip wherein the finishing temperature is between 800 and 1050° C.; cooling and coiling the hot-rolled strip between 500 and 700° C.; pickling the hot-rolled strip; cold-rolling the pickled hot-rolled strip, preferably with a total cold rolling reduction of between 40 and 80%. To reduce the rolling force during cold rolling, the coiled strip or partially cold rolled strip may be subjected to hot band annealing. In the latter case, the band annealing temperature should preferably be in the range of 500° C. to 700° C. Thin slab casting, strip casting or the like can also be applied. In the latter case it is acceptable for the manufacturing method to skip at least a part of the hot rolling process.

The cold rolled steel thus obtained is subjected to a thermal treatment. The cold rolled steel is heated to a pre-determined austenization temperature T2 and held for a time t2, and then quenched at controlled cooling rates V4 of at least 25° C./s to a temperature T4 between Ms and Mf and optionally held for a time t4, at which stage some martensite is formed. After that, the steel is heated up to a temperature T5 in the range of Ms to Bs for austempering for a time t5 of between 15 to 150 s for carbon partitioning and further transformation of the untransformed austenite to bainitic ferrite.

The cold rolled steel is annealed at temperature T2 in the austenite single-phase region for a time t2. T2 should be above Ac3−20° C., preferably above Ac3, more preferably in a range of Ac3 to Ac3+50° C. For the composition according to the invention typical temperature will be between 780 and 900° C. The soaking time t2 is in a range from 1 to 300 seconds, preferably 5 to 200 seconds, more preferably 10 to 120 seconds, most preferably 30 to 90 seconds. Annealing at a temperature in the austenite single-phase region is necessary to allow the formation of the low temperature transformed phases (partitioned) martensite and bainitic ferrite during the Q&P process, as they are obtained from high temperature austenite. T2 should be sufficiently high and t2 sufficiently long to minimize the formation of proeutectoid ferrite. If T2 is higher than Ac3+50° C. or t2 is longer than 300 seconds, austenite grains will grow, which influences the size and distribution of the retained austenite and slows down the bainitic transformation kinetics later in the partitioning process. Excess fresh martensite formed during final cooling may form as a result of this incomplete bainitic transformation, which leads to a higher strength but a low ductility and formability. If T2 is lower than Ac3−20° C. or the annealing time t2 is shorter than 1 s, reverse transformation to austenite may not proceed sufficiently and/or carbides in the steel may not be dissolved sufficiently. The inhomogeneity in the austenite phase may also lead to the formation of proeutectoid ferrite during annealing or during cooling stage. Accordingly, the annealing temperature needs to be equal to or higher than Ac3−20° C., but should not exceed Ac3+50° C. The annealing time is 1 second to 300 seconds and preferably 10 seconds to 120 seconds.

After austenization at T2, the steel is controllably cooled to a temperature T4 between Mf and Ms, preferably between Ms−200° C. and Ms−80° C. at an average cooling rate V4 of at least 25° C./s. This is referred to as the fast cooling step. The purpose of this fast cooling step is to obtain the required amount of martensite while preventing the formation of ferrite and pearlite. V4 should be at least 25° C./s, preferably at least 30° C./s to prevent the formation of ferrite and pearlite during cooling. The upper limit V4 is not particularly restricted unless variation in temperature occurs in the steel when the cooling is stopped. V4 is preferably 100° C./s or lower in standard facilities because such standard facilities experience significant large variations in microstructure both in the longitudinal and transverse direction of the steel product when the average cooling rate exceeds 100° C./s.

The temperature T4 should at least be Mf, preferably Ms−200° C., typically at least 150° C. The amount of partitioned martensite formed depends mainly on the temperature T4. The formation of PM accelerates the bainitic transformation in the following step. Therefore, the amount of PM and BF in the final microstructure are dependent on T4. In general, the lower the T4 is, the more partitioned martensite but less bainitic ferrite forms. If T4 is below Mf, too much austenite is transformed to partitioned martensite and the amount of retained austenite will be too low, thereby minimizing the TRIP effect and associated ductility of the obtained product. The temperature T4 should at most be Ms, preferably Ms−80° C., more preferably Ms−100° C., typically at most 250° C. Above Ms partitioned martensite cannot be obtained and bainitic transformation may not complete during partitioning resulting in too much fresh martensite in the final microstructure.

The time t4 should preferably be controlled between 1 and 10 s, preferably between 1 and 5 s. Although the time t4 is not critical for the microstructural properties, limitation of the typical available production lines requires a short holding time at t4 such that sufficient time is left for the partition step to complete bainitic transformation and to stabilize the retained austenite The steel is then heated to a temperature T5 ranging from Ms to Bs temperature and overaged at T5 for a period t5 ranging 15 seconds to 150 seconds for partition process. At temperature T5, C partitioning occurs in the quenched martensite. The martensite transforms to partitioned martensite and the untransformed austenite continues to transform into carbide-free bainitic ferrite. The average C content in the retained austenite is increased as the time t5 is increased, so that retained austenite is made stable.

If T5 exceeds Bs, carbides may precipitate in the remaining austenite and the desired microstructure of steel cannot be obtained. Preferably, the T5 is below Bn+30° C. to obtain fast bainitic transformation kinetics. If T5 is below Ms, the degree of C partitioning is insufficient in the partitioned martensite and the carbon concentration in retained austenite is not high enough to stabilize it in a limited time, which is a known constrain in typical available production lines. In addition, the untransformed austenite may not sufficiently transform to BF as the bainitic transformation kinetics slow down too much. Accordingly, the T5 temperature should be above Ms, preferably above Ms+50° C.

The partition time t5 at T5 must be long enough to allow the non-transformed austenite into bainitic ferrite and to allow C enrichment in the retained austenite. The invented steel includes enriched components such as C, Mn, Si, which normally slow down bainite transformation. It was found that the existence of quenched martensite significantly enhanced the bainite transformation kinetics. The inventors found that the bainitic transformation was sufficiently complete at a time t5 from 15 s to 150 s, which is believed to be related to the presence of enough martensite. When t5 is less than 15 s, the partitioning of martensite is insufficient, the desired microstructure may not be obtained, and thus good formability of the steel product may not be sufficiently ensured. When t5 is longer than 150 seconds, carbides tend to precipitate in non-transformed austenite and stable retained austenite having relatively high carbon concentration cannot be obtained in the final microstructure, resulting in a steel product with insufficient strength and ductility. Accordingly, t5 is 15 to 150 s, preferably 30 s to 100 s.

The steel is then cooled down to below 300° C. at a cooling rate V6 of at least 1° C./s, preferably at least 5° C./s, after which it is further cooled down to ambient temperature, by either forced cooling or uncontrolled natural cooling.

In an embodiment of the invention, the cold-rolled steel is preferably annealed in a continuous annealing furnace to ensure a homogeneous product with the desired properties as the heating and cooling process can be accurately controlled. The batch annealed process is economically unattractive and less reliable due to the slow heating and cooling which potentially result in an inhomogeneous product.

In an embodiment of the invention, in particular to match a line speed in a continuous annealing line, a two-step heating to the austenization temperature can be applied. The cold rolled steel is first heated to a temperature T1, in a range from Ac1−20° C. to Ac1+20° C., preferably with a heating rate V1 of 10-25° C./s, and then to the temperature T2, preferably at a slow heating rate V2 of 1-10° C./s, preferably at a heating rate V2 of 1-5° C./s.

In a further embodiment of the invention, the fast cooling step (step C) can be preceded by a slow cooling step, typically carried out in a continuous annealing line. Most of the available continuous annealing lines have two cooling sections, a slow cooling section followed by a fast cooling section and the time span at each section is fixed for a given line speed. In this case, the steel is first cooled at a cooling rate of V3 to a temperature T3 above Ar3, preferably in the range of 680 to 800° C., preferably 700 to 780° C. to fit the configuration of a production line. The T3 temperature should be high enough to prevent the formation of proeutectoid ferrite during the slow cooling step. During this slow cooling, the temperature distribution in the steel becomes more uniform. As the total length of the cooling section is fixed, the T3 be can used to regulate V3 and V4. The higher the T3 is, the lower the V3 is and the higher the V4 is. The V3 does not have a significant effect on the microstructure and properties if T3 is above Ar3, preferably V3 is in the range of 1-15° C./s, more preferably 1-5° C./s.

In a further embodiment of the invention, at least part of the process may be performed in a hot forming press, wherein the steel is hot-press-formed during step C to form a hot-press formed product directly. A cold rolled steel, typically a blank, is first heated to a temperature T2 (step B), for example in an electrical furnace. The cold rolled steel is then transferred to the hot forming press. During transfer, the steel temperature may decrease due to heat losses to the environment to a temperature T3. The press forming is then applied to form a hot-press formed product. During press forming, the blank temperature decreases at a rate V4 of at least 25° C., typically between 60 and 250° C./s to T4 (step C), which can be controlled by the initial die temperature of the hot forming press. Finally, the formed part is moved to a furnace with a predetermined temperature T5 and holding for t5 (step D) and the cooling to ambient temperature in air (step E).

In a further embodiment of the invention, the steel product may further be subjected to a coating process as well known to a person skilled in the art, wherein the steel product is provided with a metallic coating by means of plating or hot-dipping, preferably wherein the metallic coating is an aluminium based alloy or a zinc based alloy. The coating may be applied after cooling to ambient temperature or in between the process steps.

In an embodiment of the invention, the steel product may be coated during the partitioning process (step D) at temperature T5 for the coating time t5 as specified above.

In an alternative embodiment of the invention, the steel product may be coated after the partitioning process at a temperature T6 for a better coating performance. T6 should be in the range from Bn to Bs, preferably in the range of 450° C. to 500° C. The time t6 is preferably in the range of 1 to 30 s. During this step, the overall microstructure transformation continues, and the untransformed austenite continues to transform to bainitic ferrite. Therefore, the total time t5+t6 should be in the range of 15 to 150 s, preferably in the range of 30 to 100 s to limit the precipitation of carbides in non-transformed austenite and obtain the microstructure according to the invention.

In a further embodiment of the invention a temper rolling treatment may be performed with the annealed and optionally zinc coated steel product to fine tune the tensile properties and modify the surface appearance and roughness depending on the specific requirements resulting from the intended use.

According to a third aspect the invention is also embodied in a car, truck or structural or engineering component, a component of the body in white, a component of the frame or the subframe, or a component of a structure or engineering project, said component having been produced from the steel product according to the invention.

The invention will now be described with reference to the following non-limiting examples.

Steels having compositions shown in Table 1 were cast into ingots. The ingots were reheated to 1250° C. and soaked for 1 hour and then rough hot-rolled to 35 mm thickness. The shrinkage and segregation zone from both ends were cut off. The cut blocks were reheated at 1200° C. for 30 min and then hot-rolled to 3 mm thickness in 5 passes. The finish rolling temperature was about 900° C. The hot rolled strips were cooled to 650° C. in a furnace at a rate of 30° C./s and held at 650° C. for 2 hrs and cooled to room temperature to simulate a coiling process.

The strip was cold-rolled to produce a 1 mm thick steel sheet (65% reduction in thickness). The cold-rolled steel sheet was annealed and then heat treated using a continuous annealing simulator (CASIM). An example of a time-temperature profile of the heat treatments following the cold rolling are schematically demonstrated in FIG. 1. The steel sheets were first preheated to 700° C. and subsequently increased to a temperature T2 of 805 or 840° C. with a heating rate V2 of 1.08° C./s and 1.44° C./s respectively and were kept at this temperature for 65 s (t2). Next the steel sheets were either cooled down with fast cooling directly to T4, or with a first slow cooling to T3 followed by a fast cooling to T4 as specified in Table 2. The samples were maintained at this temperature for a duration of 3 s (t4). Next, the steel sheets were heated to T5 in 2 seconds and held at T5 for 53 s. All samples were subsequently heated up to T6, to mimic the hot dip coating step and maintained at T6 for 17 s, keeping t5+t6 well under 150 s. The sheets were cooled down to 300° C. at a cooling rate of 7° C./s (V6) and further cooled to ambient temperature at a cooling rate of 10.5° C./s (V7) after which the samples were prepared for microstructure observations, tensile test and hole expansion tests.

Dilatometry was done on the cold rolled samples of 10 mm×5 mm×1 mm dimensions (length along the rolling direction). The critical phase transformation points were determined from the quenched dilatometry curves and are given in Table 1. The phase fractions during annealing for different process parameters were determined from dilatation curves simulating the annealing cycles.

Tensile tests—JIS5 test pieces (gauge length=50 mm; width=25 mm) were machined from the annealed sheets such that the tensile direction was parallel to the rolling direction. Room temperature tensile tests were performed in a Schenk TREBEL testing machine following NEN-EN10002-1:2001 standard to determine tensile properties (yield strength YS (MPa), ultimate tensile strength UTS (MPa), total elongation TE (%)). For each condition, three tensile tests were performed and the average values of mechanical properties are reported.

Hole Expansion Test (Stretch Flangeability Evaluation Test)—Test pieces for testing hole expandability (size: 90×90 mm) were sampled from the obtained rolled sheet. In accordance with The Japan Iron and Steel Federation Standards JFS T 1001, a 10 mm diameter punch hole was punched in the centre of the test piece and a 60° conical punch was pushed up and inserted into the hole. When a crack penetrated the sheet thickness, the hole diameter d (mm) was measured. The hole expansion capacity (HEC) λ (%) was calculated by the following equation: $\lambda(\%)=\{(d-d0)/d0\}\times 100$, with d0 being 10 mm.

Bending test—Bending specimens (40 mm×30 mm) from parallel and transverse to rolling directions were prepared from each of the conditions and tested by three-point bending test according to the VDA 238-100 standard. The experiments were stopped at different bending angles and the bent surface of the specimen was inspected for identification of failure in order to determine the bending angle (BA). The bending angles of the samples with bending axis parallel to the rolling direction are lower than those of the samples with bending axis perpendicular to the rolling direction. For each type of tests, three samples were tested and the average values from three tests are presented for each condition.

The tensile properties are given in Table 2.

The volume fraction of each of ferrite, martensite, and partitioned martensite was determined using a commercially available image-processing program by assuming that the volume fraction is equal to the area fraction. The microstructures were observed at ¼ thickness in the cross section of rolling and normal directions of a steel sheet. SEM (scanning electron microscope) was applied to quantify the microstructure at a magnification of 1500 times. The area fraction of each of ferrite, fresh martensite, and partitioned martensite and bainitic ferrite is the fraction of the area of each phase in an observed region.

The volume fraction of retained austenite and cementite were measured via intensity measuring method based on X-ray diffraction (XRD) according to ASTM E975-13.The X-ray measurements were conducted on the subsurface at ¼ thickness of the steel sheet. The steel sheet is mechanically and chemically polished and is then analyzed by measuring the integral intensity of each of the (200) plane, (220) plane, and (311) plane of fcc iron and that of the (200) plane, (211) plane, and (220) plane of bcc iron with an X-ray diffractometer using Co-Ka. The amount of retained austenite (RA) and the lattice parameter in the retained austenite were determined using Rietveld analysis. The C-content in the retained austenite is calculated using the formula:

$$C\ (wt\ \%)=(a[Å]-3.572-0.0012\ wt\ \%\ Mn+0.00157\ wt\ \%\ Si-0.0056\ wt\ \%\ Al)/0.033$$

Where a is the lattice parameter of the retained austenite in angstrom.

The results of these measurements and the hole expansion and bending tests are given in Table 3.

TABLE 1

The compositions* of the cast steels (in wt %) and the phase transition temperatures (° C.)

| Alloy | C | Mn | Si | Al | Cr | Ni | Cu | Nb | Mo | S | P |
|---|---|---|---|---|---|---|---|---|---|---|---|
| A | 0.418 | 1.979 | 2.005 | 0.032 | 0.307 | 0.001 | 0.005 | 0.001 | 0.001 | 0.0011 | 0.006 |
| B | 0.355 | 2.448 | 2.001 | 0.036 | 0.524 | 0.001 | 0.005 | 0.001 | 0.003 | 0.0003 | 0.007 |
| C | 0.309 | 2.477 | 1.494 | 0.036 | 0.526 | 0.001 | 0.005 | 0.001 | 0.002 | 0.0008 | 0.007 |
| D | 0.355 | 2.481 | 1.534 | 0.036 | 0.528 | 0.001 | 0.005 | 0.001 | 0.003 | 0.0005 | 0.006 |
| E | 0.41 | 1.501 | 1.499 | 0.032 | 0.001 | 0.001 | 0.005 | 0.001 | 0.001 | 0.001 | 0.006 |
| F | 0.414 | 2.003 | 1.023 | 0.032 | 0.312 | 0.001 | 0.005 | 0.001 | 0.002 | 0.0024 | 0.006 |
| G | 0.411 | 1.002 | 1.495 | 0.031 | 0.725 | 0.001 | 0.005 | 0.001 | 0.001 | 0.0011 | 0.006 |
| H | 0.389 | 2.253 | 1.48 | 0.029 | 0.724 | 0.001 | 0.005 | 0.001 | 0.002 | 0.002 | 0.006 |
| I | 0.45 | 2.478 | 1.53 | 0.033 | 0.529 | 0.001 | 0.005 | 0.001 | 0.003 | 0.0007 | 0.007 |

| Alloy | Ti | V | N | Mn + Cr | Si + Al | Ac3 | Ms | Mf | Bs |
|---|---|---|---|---|---|---|---|---|---|
| A | 0.001 | 0.002 | 0.0017 | 2.286 | 2.037 | 835 | 311 | 76 | 493 |
| B | 0.001 | 0.003 | 0.0023 | 2.972 | 2.037 | 838 | 317 | 90 | 452 |
| C | 0.001 | 0.003 | 0.0017 | 3.003 | 1.53 | 832 | 353 | 101 | 472 |
| D | 0.001 | 0.003 | 0.0019 | 3.009 | 1.57 | 822 | 309 | 83 | 460 |
| E | 0.001 | 0.001 | 0.001 | 1.502 | 1.531 | 825 | 368 | 106 | 568 |
| F | 0.001 | 0.002 | 0.0008 | 2.315 | 1.055 | 807 | 300 | 83 | 514 |
| G | 0.001 | 0.003 | 0.0019 | 1.717 | 1.526 | 834 | 366 | 101 | 563 |
| H | 0.001 | 0.003 | 0.0013 | 2.977 | 1.509 | 817 | 274 | 78 | 460 |
| I | 0.001 | 0.003 | 0.0022 | 3.007 | 1.563 | 806 | 265 | 62 | 440 |

*The B content for all cast steels is below 0.0003.

TABLE 2

Process parameters and properties tensile strength (Rm), Yield Strength (Rp), Total Elongation (A) and Uniform Elongation (Ag)

| Alloy | Process | T1 ° C. | V1 ° C./s | T2 ° C. | t2 s | V3 ° C./s | T3 ° C. | V4 ° C./s | T4 ° C. | t4 S | T5 ° C. | t5 s | T6 ° C. | t6 s | V6 ° C./s | T7 ° C. | Rp MPa | Rm MPa | Ag % | A % |
|---|---|---|---|---|---|---|---|---|---|---|---|---|---|---|---|---|---|---|---|---|
| A | P1 | 700 | 1.44 | 840 | 65 | 102 | 700 | 102 | 200 | 3 | 400 | 53.2 | 475 | 16.9 | 7.14 | 300 | 1132 | 1435 | 15.3 | 20 |
| A | P2 | 700 | 1.44 | 840 | 65 | 3.08 | 680 | 30.8 | 200 | 3 | 400 | 53.2 | 475 | 16.9 | 7.14 | 300 | 1018 | 1424 | 13.7 | 17.8 |
| A | P3 | 700 | 1.44 | 840 | 65 | 30.6 | 720 | 30.6 | 200 | 3 | 400 | 53.2 | 475 | 16.9 | 7.14 | 300 | 987 | 1407 | 14.7 | 18.8 |
| B | P4 | 700 | 1.44 | 840 | 65 | 3.08 | 680 | 117.5 | 160 | 3 | 400 | 53.2 | 475 | 16.9 | 7.14 | 300 | 1158 | 1500 | 12.5 | 16.4 |
| B | P5 | 700 | 1.44 | 840 | 65 | 105 | 550 | 105 | 200 | 3 | 400 | 53.2 | 475 | 16.9 | 7.14 | 300 | 930 | 1519 | 13.7 | 16.6 |
| B | P6 | 700 | 1.44 | 840 | 65 | 3.08 | 680 | 132.3 | 180 | 3 | 400 | 53.2 | 475 | 16.9 | 7.14 | 300 | 1029 | 1502 | 12.7 | 16.3 |
| B | P7 | 700 | 1.44 | 840 | 65 | 30.5 | 740 | 30.5 | 200 | 3 | 400 | 53.2 | 475 | 16.9 | 7.14 | 300 | 870 | 1459 | 12.2 | 14.6 |
| C | P8 | 700 | 1.44 | 840 | 65 | 3.08 | 680 | 128.8 | 180 | 3 | 400 | 53.2 | 475 | 16.9 | 7.14 | 300 | 1125 | 1376 | 10.3 | 14.3 |
| C | P9 | 700 | 1.44 | 840 | 65 | 3.08 | 680 | 109.3 | 160 | 3 | 400 | 53.2 | 475 | 16.9 | 7.14 | 300 | 1167 | 1376 | 9.7 | 13.3 |
| D | P10 | 700 | 1.44 | 840 | 65 | 3.08 | 680 | 113.1 | 160 | 3 | 400 | 53.2 | 475 | 16.9 | 7.14 | 300 | 1126 | 1479 | 11.3 | 14.8 |
| D | P11 | 700 | 1.44 | 840 | 65 | 30.5 | 700 | 30.5 | 200 | 3 | 400 | 53.2 | 475 | 16.9 | 7.14 | 300 | 883 | 1464 | 11.4 | 13.6 |
| D | P12 | 700 | 1.08 | 805 | 65 | 3.08 | 680 | 85.6 | 205 | 3 | 355 | 53.2 | 475 | 16.9 | 7.14 | 300 | 952 | 1496 | 11.4 | 13.9 |
| E | P13 | 700 | 1.44 | 840 | 65 | 28.4 | 720 | 28.4 | 225 | 3 | 400 | 53.2 | 475 | 16.9 | 7.14 | 300 | 1089 | 1243 | 6.1 | 9.1 |
| E | P14 | 700 | 1.08 | 805 | 65 | 3.08 | 680 | 78 | 225 | 3 | 355 | 53.2 | 475 | 16.9 | 7.14 | 300 | 558 | 1124 | 17.8 | 22.7 |
| F | P15 | 700 | 1.08 | 805 | 65 | 3.08 | 680 | 80.5 | 240 | 3 | 355 | 53.2 | 475 | 16.9 | 7.14 | 300 | 1005 | 1403 | 9.4 | 12.5 |
| F | P16 | 700 | 1.08 | 805 | 65 | 3.08 | 680 | 87.7 | 210 | 3 | 355 | 53.2 | 475 | 16.9 | 7.14 | 300 | 1055 | 1401 | 9.1 | 12.2 |
| G | P17 | 700 | 1.08 | 805 | 65 | 3.08 | 680 | 82.6 | 260 | 3 | 355 | 53.2 | 475 | 16.9 | 7.14 | 300 | 502 | 960 | 12.6 | 16.4 |
| G | P18 | 700 | 1.08 | 805 | 65 | 3.08 | 680 | 73.9 | 230 | 3 | 355 | 53.2 | 475 | 16.9 | 7.14 | 300 | 519 | 950 | 10 | 13.2 |
| H | P19 | 700 | 1.44 | 840 | 65 | 3.08 | 680 | 108.7 | 200 | 3 | 400 | 53.2 | 475 | 16.9 | 7.14 | 300 | 837 | 1593 | 11.4 | 14.1 |
| H | P20 | 700 | 1.44 | 840 | 65 | 3.08 | 680 | 110.1 | 180 | 3 | 400 | 53.2 | 475 | 16.9 | 7.14 | 300 | 983 | 1565 | 12.4 | 15 |
| I | P21 | 700 | 1.08 | 805 | 65 | 3.08 | 680 | 119.8 | 170 | 3 | 355 | 53.2 | 475 | 16.9 | 7.14 | 300 | 816 | 1689 | 12.2 | 13.8 |

TABLE 3

Microstructure, bending and HEC.

| Alloy | Process | PF [%] | PM [%] | PM + BF [%] | FM [%] | Carbides [%] | RA [%] | C in RA [wt %] | Bending [o] | HEC [%] |
|---|---|---|---|---|---|---|---|---|---|---|
| A | P1 | 0 | 72 | 80 | 0 | <0.5 | 20 | 1.12 | 94.9 | 19 |
| A | P2 | 5 | 64 | 68 | 2 | <0.5 | 25 | 1.15 | 77.5 | 13 |
| A | P3 | 5 | 69 | 71 | 3 | <0.5 | 21 | 1.16 | — | 16 |
| B | P4 | 3 | 77 | 77 | 0 | <0.5 | 20 | 1.04 | 90.4 | 18 |
| B | P5 | 0 | 76 | 76 | 0 | <0.5 | 24 | 1.42 | 75.2 | 10 |
| B | P6 | 3 | 72 | 72 | 0 | <0.5 | 25 | 0.99 | 82.5 | 15 |
| B | P7 | 11 | 69 | 69 | 0 | <0.5 | 20 | 1.05 | 74.8 | 2 |
| C | P8 | 7 | 74 | 74 | 0 | <0.5 | 19 | 0.94 | 91.7 | 27 |
| C | P9 | 7 | 76 | 76 | 0 | <0.5 | 17 | 0.98 | 82.9 | 11 |
| D | P10 | 0 | 81 | 81 | 0 | <0.5 | 19 | 0.99 | 84.8 | 20 |
| D | P11 | 5 | 77 | 77 | 0 | <0.5 | 18 | 0.99 | 74.1 | 6 |
| D | P12 | 0 | 70 | 73 | 5 | <0.5 | 22 | 0.96 | 68.2 | 8 |
| E | P13 | 19 | 56 | 70 | 0 | <0.5 | 11 | 1.33 | 115.0 | 48 |
| E | P14 | 36 | 22 | 41 | 2 | <0.5 | 21 | 1.21 | 103.0 | 11 |
| F | P15 | 0 | 56 | 89 | 0 | <0.5 | 11 | 1.1 | 86.3 | 9 |
| F | P16 | 0 | 78 | 85 | 0 | <0.5 | 16 | 1.09 | 83.9 | 23 |
| G | P17 | 33 | 55 | 55 | 2 | 3.5 | 6 | 1.04 | 94.8 | 21 |
| G | P18 | 27 | 61 | 61 | 2 | 2.5 | 8 | 1.08 | 96.0 | 14 |
| H | P20 | 0 | 79 | 79 | 0 | <0.5 | 21 | 1.04 | 78.1 | 5 |
| I | P21 | 0 | 78 | 78 | 0 | <0.5 | 22 | 1.02 | 52.9 | 3 |

It can be observed from the tables that steel A, B, C, D, F, H and I, which are embodiments according to the invention have excellent tensile strength, yield strength and elongation. Steel E, lacking Cr, clearly shows lower tensile strength and elongation properties. Steel G clearly shows inferior yield strength and tensile strength because the annealing temperature (T2=805° C.) is too low and too much amount of ferrite is obtained. Furthermore, it can be seen that most of the inventive samples do also display good bending properties and HEC values.

FIG. 1—This FIGURE shows a representative process according to the invention and the various process parameters used during the process.

The invention claimed is:

1. A high strength steel product with a chemical composition comprising:

0.20-0.55 wt. % C;
1.00-3.50 wt. % Mn;
0.05-2.50 wt. % Cr;
0.50-3.00 wt. % Si;
0.01-1.00 wt. % Al;
1.00-4.00 wt. % of Σ (Si+Al);
1.50-6.00 wt. % of Σ (Cr+Mn);
at most 0.050 wt. % P;
at most 0.020 wt. % S;
at most 0.010 wt. % N;
and optionally one or more of:
0.05-0.50 wt. % Cu;
0.05-1.00 wt. % Ni;
0.05-0.50 wt. % Mo;
0.01-0.10 wt. % Nb;
0.01-0.10 wt. % Ti;
0.01-0.10 wt. % V;
0.0003-0.0050 wt. % B;

0.01-0.15 wt. % of Σ (Nb+Ti+V);
0.0003-0.0100 wt. % of Σ (Ca+REM);
remainder iron and inevitable impurities;
and wherein the microstructure comprises at least 40% partitioned martensite and 60-90% of Σ (partitioned martensite+bainitic ferrite) and 0-15% of proeutectoid ferrite and 0-5% of fresh martensite and 0-1.5% of carbides and 5-35% of retained austenite; and
wherein the retained austenite comprises an average C content of 0.90% or more, wherein the microstructure comprises partitioned martensite+bainitic ferrite as a matrix of a mixture of the partitioned martensite+bainitic ferrite.

2. The high strength steel product of claim 1, having a tensile strength of at least 1300 MPa and/or a total elongation of at least 13%.

3. The high strength steel product of claim 1, wherein the chemical composition comprises
0.25-0.50 wt. % C and/or
1.50-3.00 wt. % Mn and/or
0.20-2.00 wt. % Cr and/or
0.80-2.50 wt. % Si and/or
0.05-0.70 wt. % Al and/or
1.30-3.20 wt. % of Σ (Si+Al) and/or
2.00-4.00 wt. % of Σ (Cr+Mn).

4. The high strength steel product of claim 1, wherein Cu and/or Ni and/or Mo and/or Nb and/or Ti and/or V and/or B belongs to the inevitable impurities, wherein the microstructure comprises less than 0.5% of carbides.

5. The high strength steel product of claim 1, wherein the microstructure comprises a total percentage of the partitioned martensite+bainitic ferrite of 70-80%, wherein the partitioned martensite+the bainitic ferrite are carbide free, wherein the microstructure comprises a larger amount of partitioned martensite than bainitic ferrite.

6. The high strength steel product of claim 1, wherein the microstructure comprises fine retained austenite present on a boundary of lath-shaped bainitic ferrite and/or partitioned martensite.

7. The high strength steel product of claim 1, wherein the microstructure comprises 0% of carbides.

8. The high strength steel product of claim 1, wherein the microstructure comprises at least 50% of partitioned martensite.

9. A process for producing a high strength steel product according to claim 1 comprising the steps of:

A. providing a cold rolled steel having the following composition:
0.20-0.55 wt. % C;
1.00-3.50 wt. % Mn;
0.05-2.50 wt. % Cr;
0.50-3.00 wt. % Si;
0.01-1.00 wt. % Al;
1.00-4.00 wt. % of Σ (Si+Al);
1.50-6.00 wt. % of Σ (Cr+Mn);
at most 0.050 wt. % P;
at most 0.020 wt. % S;
at most 0.010 wt. % N;
and optionally one or more of:
0.05-0.50 wt. % Cu;
0.05-1.00 wt. % Ni;
0.05-0.50 wt. % Mo;
0.01-0.10 wt. % Nb;
0.01-0.10 wt. % Ti;
0.01-0.10 wt. % V;
0.0003-0.0050 wt. % B;
0.01-0.15 wt. % of Σ (Nb+Ti+V);
0.0003-0.0100 wt. % of Σ (Ca+REM);
remainder iron and inevitable impurities;

B. heat treating the cold rolled steel at a temperature T2 above Ac3—20° C. for a duration t2 of between 1 and 300 s;

C. cooling the annealed steel, at a cooling rate V4 of at least 25° C./s to a quenching temperature T4 between Ms and Mf;

D. heat treating the annealed steel at a partitioning temperature T5 between Bs and Ms for a duration t5 of between 15 and 150 s; and E. cooling to ambient temperature, to obtain a steel product wherein the microstructure comprises at least 40% partitioned martensite and 60-90% of ≥ (partitioned martensite+bainitic ferrite) and 0-15% of proeutectoid ferrite and 0-5% of fresh martensite and 0-1.5% of carbides and 5-35% of retained austenite; and wherein the retained austenite comprises an average C content of 0.90% or more, wherein the microstructure comprises partitioned martensite+bainitic ferrite as a matrix of a mixture of the partitioned martensite+bainitic ferrite.

10. The process according to claim 9, wherein at least part of the process is performed in a hot forming press, and wherein the steel is hot-press-formed during step C.

11. The process according to claim 9, wherein between step B and C, the steel is cooled to a temperature T3 above Ar3.

12. The process according to claim 9, wherein the process further comprises a coating step, wherein the steel product is provided with a metallic coating by means of plating or hot-dipping.

13. The process according to claim 12, wherein the coating step is performed during step D.

14. The process according to claim 12, wherein the coating step is performed after step D, at a temperature T6 above Bn and below Bs, for a duration t5+t6 of between 15 and 150 s, wherein Bn is nose temperature of the bainitic transformation.

15. A component selected from a car or truck component, a component of a body in white, a component of a frame or a subframe, or a component of a structure or engineering project, said component having been produced from the steel product according to claim 1.

16. A component selected from a car or truck component, a component of a body in white, a component of a frame or the subframe, or a component of a structure or engineering project, said component having been produced from the steel product produced according to the process of claim 9.

17. The process according to claim 9, wherein the process further comprises a coating step, wherein the metallic coating is an aluminium based alloy.

18. The process according to claim 9, wherein the process further comprises a coating step, wherein the metallic coating is a zinc based alloy.

19. The process according to claim 9, wherein between step B and C, the steel is cooled to a temperature T3 between 680-800° C.

20. The process according to claim 12, wherein the coating step is performed after step D, at a temperature T6 in the range of 450° C. to 500° C. for a duration t5+t6 of between 15 and 150 s.

* * * * *